US005087801A

United States Patent [19]

Johnston

[11] Patent Number: 5,087,801

[45] Date of Patent: Feb. 11, 1992

[54] SPHERE-ACTUATED FLOAT SWITCH

[75] Inventor: Stephen P. Johnston, Detroit Lakes, Minn.

[73] Assignee: S.J. Electro Systems, Inc., Detroit, Mich.

[21] Appl. No.: 540,189

[22] Filed: Jun. 19, 1990

[51] Int. Cl.[5] ..... H01H 35/18

[52] U.S. Cl. ..... 200/84 R; 73/308; 200/553

[58] Field of Search ..... 340/625; 417/40; 73/308, 313; 200/84 R, 84 C, 61.2, 61.45 R, 61.52, 250, 290, 332, 39, 553 X, 562; 307/118

[56] References Cited

U.S. PATENT DOCUMENTS 3,553,402 1/1971 Hire ..... 200/83 P
4,021,145 5/1977 Pepper .
4,064,755 12/1977 Bongort et al. .
4,540,891 9/1985 Keener et al. .
4,618,746 10/1986 Schwob et al. .
4,667,069 5/1987 Cholteri ..... 200/83 P
4,692,576 9/9187 Frede ..... 200/84 R
4,737,759 4/1988 Stopkay et al. .
4,942,274 7/1990 Rebock ..... 200/84 C

*Primary Examiner*—Gerald P. Tolin
*Attorney, Agent, or Firm*—Merchant, Gould, Smith, Edell, Welter & Schmidt

[57] ABSTRACT

A sphere-actuated float switch is provided including (i) a cage defining a longitudinal raceway, (ii) a yoke pivotally mounted externally to the cage and having a first and second legs which extend into the raceway, (iii) an electrical switching means which is electrically open when the yoke is in a first position and electrical closed when the yoke is in a second position, (iii) an over-center spring capable of biasing the yoke into the appropriate electrically open and the electrically closed positions once the yoke is urged past a transition point, and (iv) a sphere within the raceway for urging the yoke between the electrically open and the electrically closed positions.

12 Claims, 7 Drawing Sheets

FIG. 1b
PRIOR ART
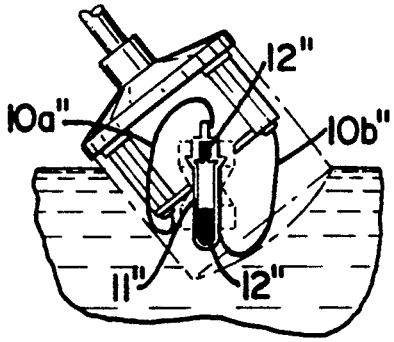
FIG. 1a
PRIOR ART
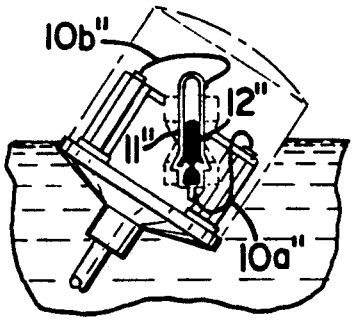
FIG. 2a
PRIOR ART
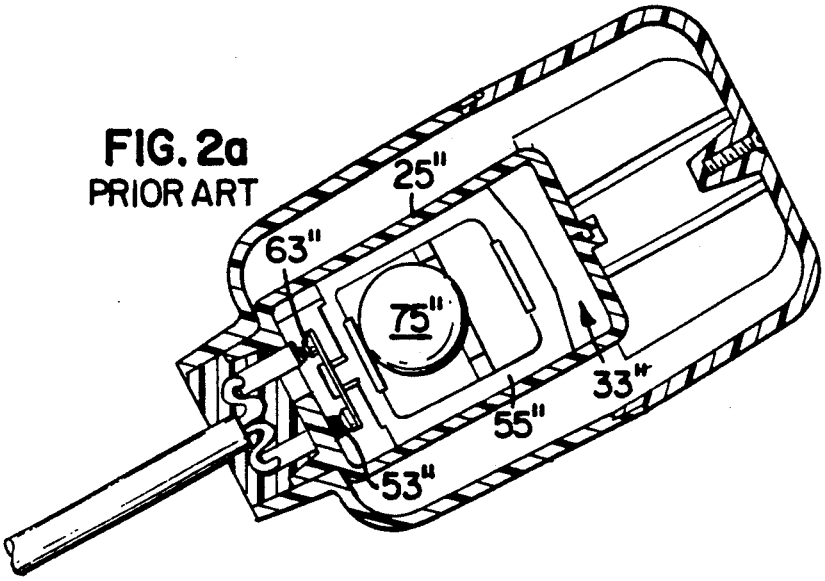
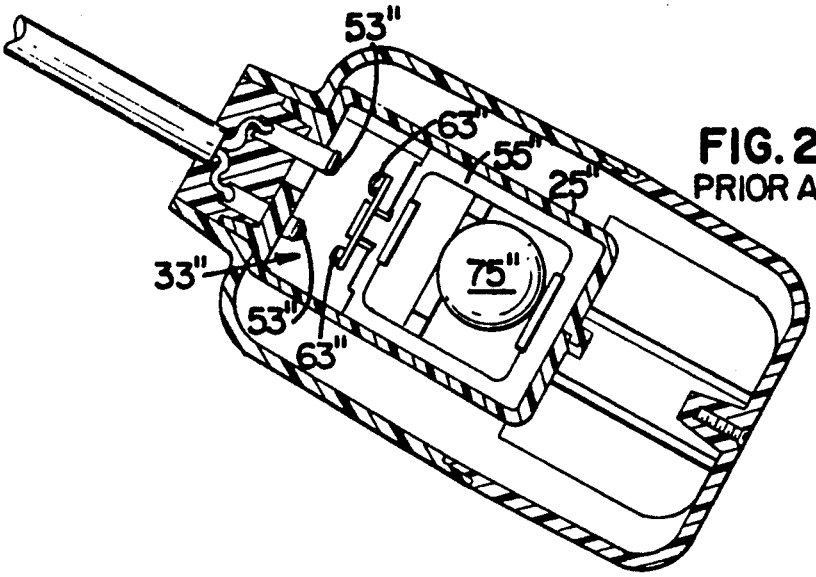
FIG. 2b
PRIOR ART FIG.5a
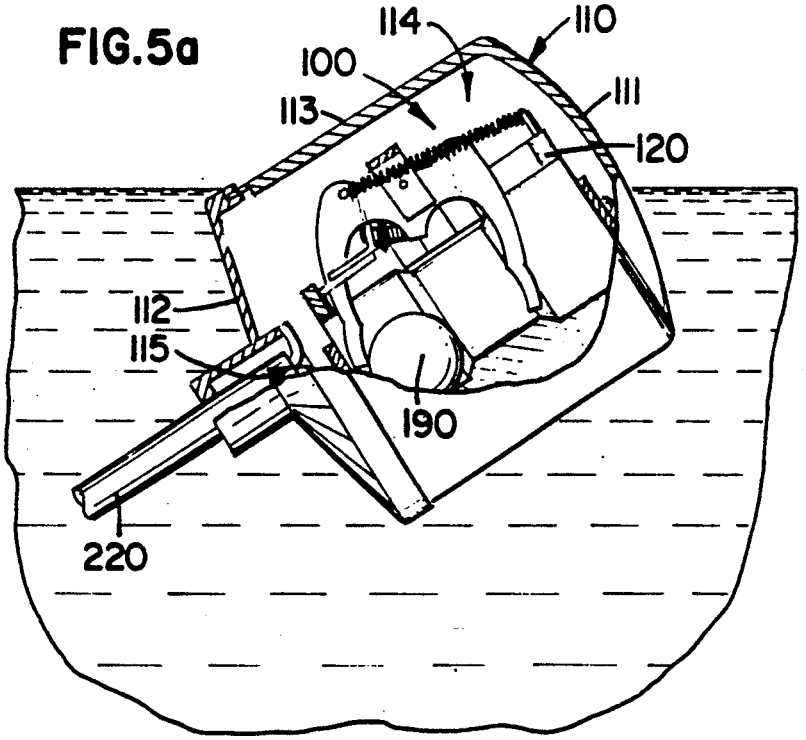
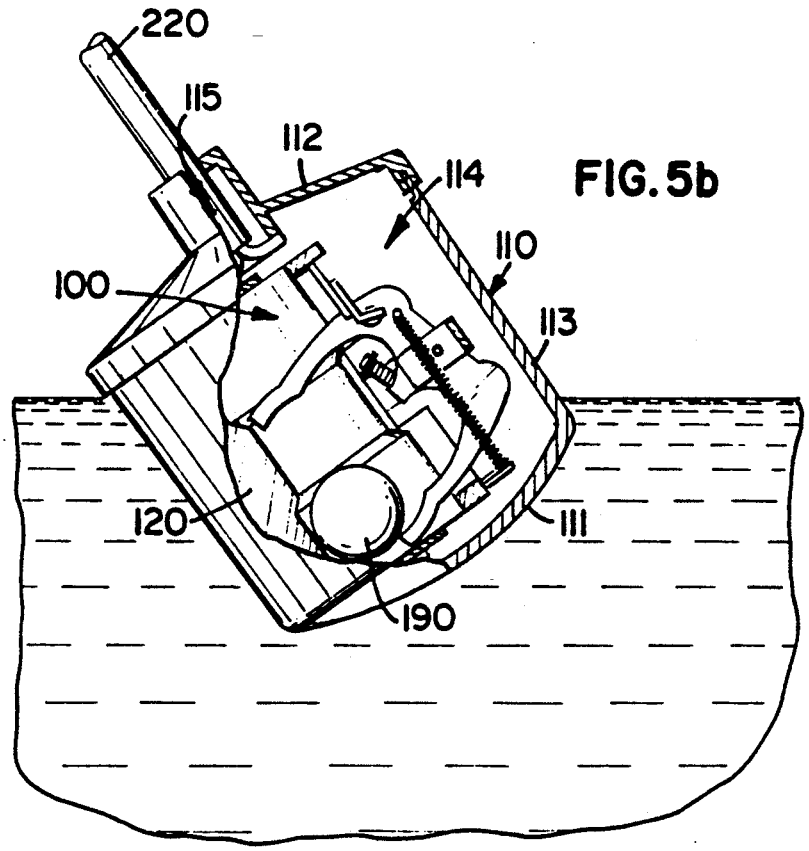
FIG.5b

SPHERE-ACTUATED FLOAT SWITCH

FIELD OF THE INVENTION

Broadly, the invention relates to float switches. Specifically, the invention relates to float switches which open and close an electrical circuit in response to the repositioning of a sphere within a raceway caused by a change in the attitude of the switch.

BACKGROUND

Many different types of float switches have been developed for opening and closing an electrical circuit in response to the level of a liquid within a reservoir. Generically, float switches includes a floating buoy and a means, responsive to the vertical position of the buoy, for alternately closing an electrical circuit when the float achieves a predetermined maximum height and opening the electrical circuit when the float achieves a predefined minimum height (normally open) or visa versa (normally closed).

One type of available float switch is known as a mercury-actuated switch. Referring to FIGS. 1*a* and 1*b*, a typical, normally open, mercury-actuated float switch includes an electrode 10*a*", 10*b*" which extend into a sealed tube 11" containing mercury 12". The mercury 12" resides at a second end of the tube 11" and electrically closes the electrode 10*a*", 10*b*" after the float switch has attained a predefined upward vertical angle caused by a high liquid level within the reservoir (FIG. 1*a*). Conversely, the mercury 12" resides at a first end of the tube 11" and leaves the electrode 10*a*", 10*b*" electrically open after the float switch has attained a predefined downward vertical angle caused by a low liquid level within the reservoir (FIG. 1*b*).

Mercury-actuated float switches provide superior switching performance. However, because of environmental concerns relating to the use of mercury, alternatives to the mercury-actuated switch are being explored.

One type of mercury-free float switch is what is known as a sphere-actuated float switch. Generally, sphere-actuated float switches utilize movement of a sphere within a raceway caused by changes in the attitude of the raceway to effectuate opening and closing of an electrical circuit.

Examples of sphere-actuated float switches are provided in U.S. Pat. Nos. 4,644,117 (Grimes et al.) and 4,629,841 (Riback et al.). Referring to FIGS. 2*a* and 2*b*, the sphere-actuated float switch of Grimes et al. includes (i) a pair of positionable electrical contacts 63" attached to a shuttle 55" which is slidably retained within a raceway 33" defined by housing 25" and (ii) a corresponding pair of stationary electrical contacts 53" which are connected to the housing 25" and extend into the raceway 33". The shuttle 55" resides at a second end of the raceway 33" and provides contact between the electrical connections 53" and 63" after the float switch has attained a predefined upward vertical angle caused by a high liquid level within the reservoir (FIG. 2*a*). Conversely, the shuttle 55" resides at a first end of the raceway 33" and prevents contact between the electrical connections 53" and 63" after the float switch has attained a predefined downward vertical angle caused by a low liquid level within the reservoir (FIG. 2*b*). Movement of the shuttle 55" within the raceway 33" is effected by a sphere 75" which rolls within the shuttle 55" based upon the attitude of the shuttle 55". The float switch of Grimes et al. addresses the environmental concerns associated with the utilization of mercury-actuated float switches. However, the switch lacks the reliability associated with mercury-actuated float switches. Various factors contribute to this lack of reliability including specifically, but not exclusively, excessive friction between the shuttle 55" and the housing 25" resulting in failure of the sphere 75" to reposition the shuttle 55", wedging of the shuttle 55" within the raceway 33" again resulting in failure of the sphere 75" to reposition the shuttle 55", and generation of deposits upon the electrical contacts 53" and/or 63" resulting in poor electrical flow between the electrical contacts 53" and 63".

Referring to FIGS. 3*a*, 3*b* and 3*c*, the sphere-actuated float switch of Riback et al. includes (i) a longitudinally extended raceway 51" having a first longitudinal end 50" and a second longitudinal end 52" within which a sphere 54" is free to roll based upon the attitude of the raceway 51". A pivotally mounted cage 56" is positioned proximate the raceway 51" with legs 64" and 65" of the cage 56" alternately extending into the raceway 51". An actuator extension 60" extends from the cage 56" in a direction opposite the legs 64" and 65" for actuating a microswitch 62" based upon the pivoted position of the cage 56". The cage 56" resides in a first pivoted position with the sphere 54" at the second end 52" of the raceway 51", the actuator extension 60" detached from the microswitch 62", and the microswitch 62" in an electrically open mode after the raceway 51" has attained a predefined downward vertical angle caused by a low liquid level within the reservoir (FIG. 3*c*). Conversely, the cage 56" resides in a second pivoted position with the sphere 54" at the first end 50" of the raceway 51" and the actuator extension 60" in contact with the microswitch 62" so as to place the microswitch 62" in an electrically closed mode after the raceway 51" has attained a predefined upward vertical angle caused by a high liquid level within the reservoir (FIG. 3*a*). Pivoting of the cage 56" is effected by movement of sphere 54" between the first 50" and second 52" ends of the raceway 51". A locking mechanism (not shown) is employed to lock the cage 56" into the first and second pivoted positions in an effort to maintain synchronization between pivoting of the cage 56" and movement of the sphere 54". The locking mechanism releases the cage 56" to pivot between the first and second positions only when the sphere 54" depresses a pressure plate 86" which extends into the raceway 51".

The float switch of Riback et al., as with the float switch of Grimes et al., addresses the environmental concerns associated with mercury-actuated switches but lacks the reliability associated with mercury-actuated float switches. Various factors contribute to the lack of reliability including specifically, but not exclusively, insufficient momentum to effect a clean repositioning of the cage 56" and loss of synchronization between movement of the cage 56" and the sphere 54". In addition, the float switch of Riback et al. utilizes a microswitch to effectuate opening and closing of the electrical circuit based upon movement of the cage 56" rather than direct electrical contact.

Accordingly, a substantial need exists for a reliable, mercury-free float switch which can directly provide effective opening and closing of an electrical circuit under heavy electrical load conditions.

SUMMARY OF THE INVENTION

The invention is directed to a reliable float switch which includes (i) a cage defining a longitudinal raceway, (ii) a yoke which is pivotally mounted externally to the cage and having first and second legs which extend into the raceway, (iii) a biasing means capable of biasing the yoke in a first direction when the yoke is in a first longitudinal position and biasing the yoke in a second longitudinal direction, which is substantially diametrically opposed to the first direction, when the yoke is in a second position, (iv) an electrical switching means which is electrically open when the yoke is in the first position and electrically closed when the yoke is in the second position, and (v) a means for urging the yoke between the first and second positions against the bias of the biasing means based upon the longitudinal angle of the raceway.

The float switch may optionally include a second electrical switching means which is electrically closed when the yoke is in the first position and electrically opened when the yoke is in the second position.

The float switch operates to control the flow of electricity through a circuit by cycling through the steps of (i) urging an electrically open pair of electrical contacts toward an electrically closed position, (ii) biasing the pair of electrical contacts toward an electrically closed position once urging of the electrical contacts towards the electrically closed position proceeds past a transitional position, (iii) electrically closing the electrical contacts, (iv) urging the electrically closed pair of electrical contacts towards an electrically open position, (v) biasing the pair of electrical contacts toward an electrically open position once urging of one of the electrical contacts towards the electrically open position proceeds past the transitional position, and (vi) electrically opening the electrical contacts.

BRIEF DESCRIPTION OF THE DRAWINGS

FIG. 1*a* depicts a prior art mercury-actuated float switch in an electrically closed position.

FIG. 1*b* depicts the prior art mercury-actuated float switch of FIG. 1*a* in an electrically open position.

FIG. 2*a* depicts the prior art sphere-actuated float switch disclosed in U.S. Pat. No. 4,644,117 (Grimes et al.) in an electrically closed position.

FIG. 2*b* depicts the prior art sphere-actuated float switch of FIG. 2*a* in an electrically open position.

FIG. 5*a* is an elevational side view of one embodiment of the invention in an electrically closed position with a portion thereof broken away to facilitate viewing of the switch.

FIG. 5*b* depicts the invention embodiment depicted in FIG. 5*a* in an electrically open position.

DETAILED DESCRIPTION OF AN INVENTION EMBODIMENT INCLUDING A BEST MODE

Nomenclature

Figure 4:
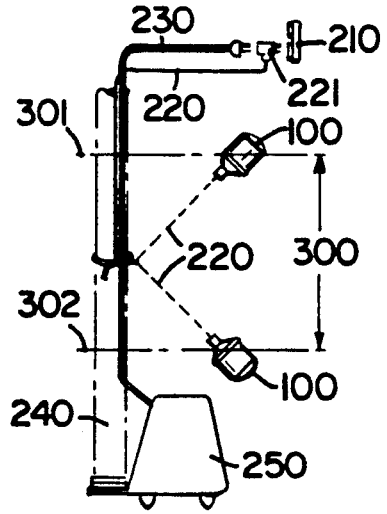
FIG. 4 is a schematic view of a float switch controlled pumping system.
Figure 3C:
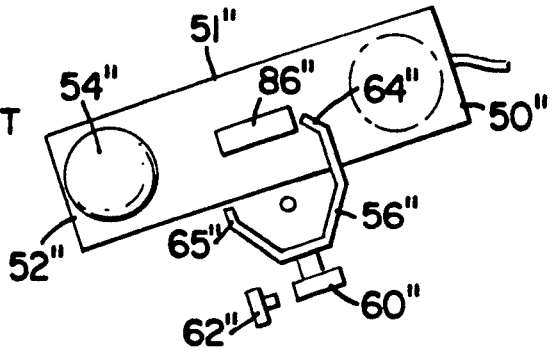
FIG. 3c PRIOR ART
FIG. 3*c* depicts the prior art sphere-actuated float switch of FIG. 3*a* in an electrically open position.
Figure 3B:
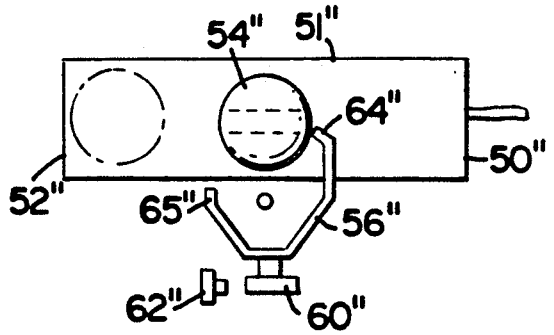
FIG. 3b PRIOR ART
FIG. 3*b* depicts the prior art sphere-actuated float switch of FIG. 3*a* in a transitional position.
Figure 3A:
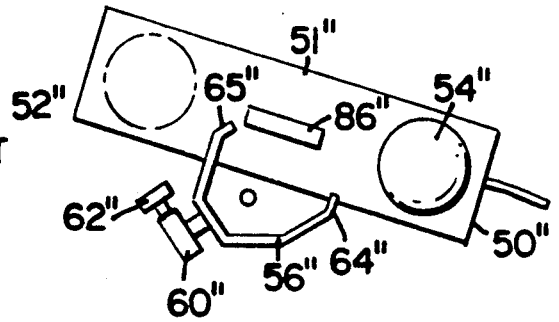
FIG. 3a PRIOR ART
FIG. 3*a* depicts the prior art sphere-actuated float switch disclosed in U.S. Pat. No. 4,629,841 (Riback et al.) in an electrically closed position.
Figure 6:
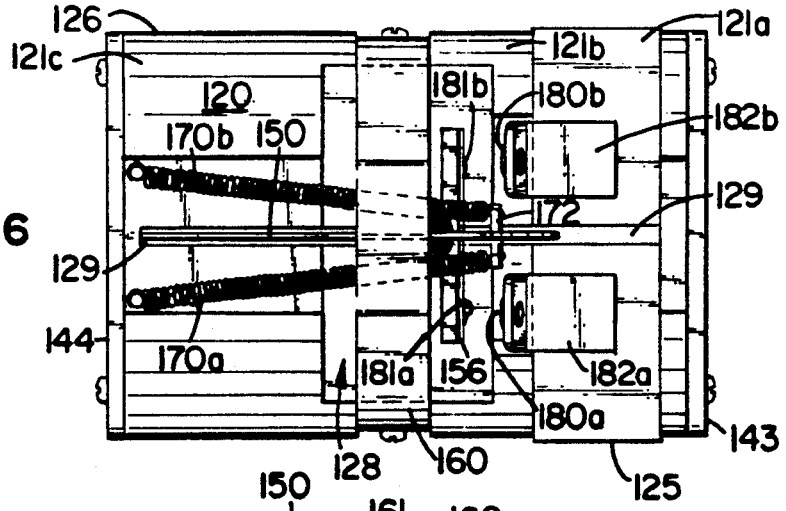
FIG. 6 is a top view of the switch depicted in FIGS. 5*a* and 5*b*.
Figure 7:
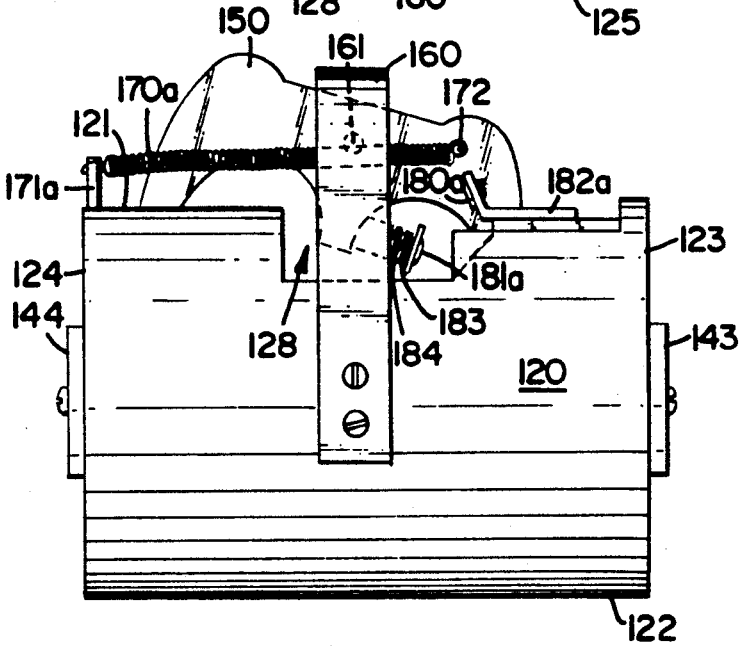
FIG. 7 is a side view of the switch depicted in FIG. 6.
Figure 8:
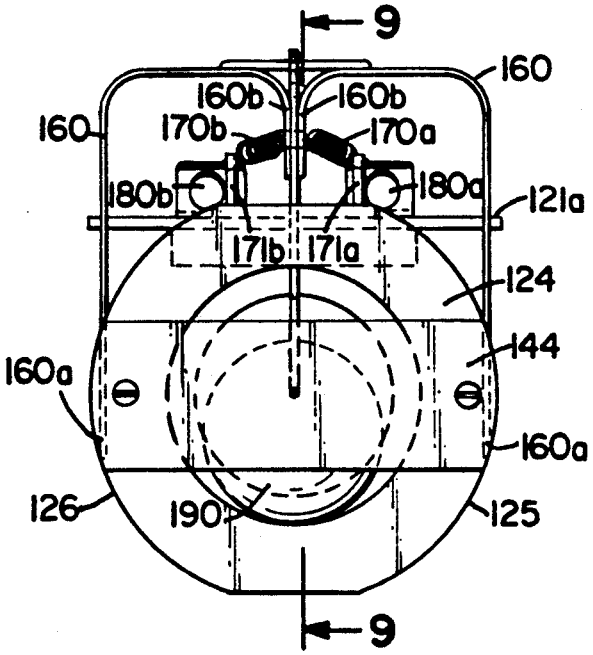
FIG. 8 is a front view of the switch depicted in FIG. 7.

100 switch
110 switch housing
111 top of switch housing
112 base of switch housing
113 sidewall of switch housing
114 chamber defined by switch housing
115 orifice through switch housing
120 cage
121 top of cage
122 bottom of cage
123 front of cage
124 back of cage
125 right side of cage
126 left side of cage
127 inner surface of cage
127*a* front planar portion of cage inner surface
127*b* front inclined portion of cage inner surface
127*c* central planar portion of cage inner surface
127*d* rear inclined portion of cage inner surface
127*e* rear planar portion of cage inner surface
128 lateral channel across top of cage
129 longitudinal slit through top of cage
130 longitudinal raceway through cage
130*a* front retention portion of longitudinal raceway
130*c* central transitory portion of longitudinal raceway
130*e* rear retention portion of longitudinal raceway
143 front cover plate
144 rear cover plate
150 yoke
153 front leg of yoke
154 rear leg of yoke
155 central projection on yoke
156 lateral extension bar
160 J-shaped brackets
160*a* long leg of J-shaped brackets
160*b* short leg of J-shaped brackets
161 center pin/pivot point
170*a* right side yoke spring
170*b* left side yoke spring
171*a* right side post
171*b* left side post
172 connector pin
180*a* front right stationary electrical contact
180*b* front left stationary electrical contact
181*a* front right positionable electrical contact
181*b* front left positionable electrical contact
182*a* front right electrical contact mounting bracket
182*b* front left electrical contact mounting bracket
183 front electrical contact extension shaft

184 contact spring
185*a* rear right stationary electrical contact
185*b* rear left stationary electrical contact
186*a* rear right positionable electrical contact
186*b* rear left positionable electrical contact
187*a* rear right electrical contact mounting bracket
187*b* rear left electrical contact mounting bracket
188 rear electrical contact extension shaft
190 sphere
210 source of electricity
220 first electrical cord
221 piggy-back plug
230 second electrical cord
240 stand pipe
250 pump
300 pumping range
301 top of pumping range
302 bottom of pumping range

Construction

Referring to FIGS. 6, 7, 8, 9*a* and 9*b*, the core of the switch 100 is a cage 120 which defines a substantially cylindrical longitudinal raceway 130 extending from the front 123 to the back 124 of the cage 120. The inner surface 127 of the cage 120 defining the raceway 130 includes (i) substantially identical front 127*a* and rear 127*e* portions which define substantially identical front 130*a* and rear 130*e* cylindrical retention portions, (ii) a central portion 127*c* between the front 127*a* and rear 127*e* retention portions which defines a central transitional portion 130*c*, (iii) a front inclined portion 127*b* between the front 127*a* and central 127*c* portions, and (iv) a rear inclined portion 127*d* between the rear 127*e* and central 127*c* portions.

The inclined portions 127*b* and 127*d* of the inner surface 127 provide a barrier which retards movement of the sphere 190 out of the front 130*a* and rear 130*e* retention portions of the raceway 130. The inclined portions 127*b*,127*d* of the inner surface 127 generates potential energy within the sphere 190 as the longitudinal angle of the raceway 130 changes and begins to urge the sphere 190 towards the other end 123,124 of the cage 120. Once the longitudinal angle is sufficient to permit the sphere 190 to roll past the inclined portion 127*b* or 127*d* which is retarding movement of the sphere 190, the sphere 190 readily proceeds through the central portion 130*c* of the raceway 130 and into the retention portion 130*a* or 130*e* of the raceway 130 at the other end 123, of the cage 120.

Front 143 and rear 144 cover plates are respectively coupled to the front 123 and rear 124 of the cage 120 over the raceway 130 in order to prevent continued longitudinal movement of the sphere 190 out of the longitudinal raceway 130.

A U-shaped yoke 150 is pivotally mounted above the top 121 of the cage 120 by means of a pair of J-shaped brackets 160. The long leg 160*a* of one bracket 160 is connected to the right side 125 of the cage 120 while the long leg 160*a* of the other bracket 160 is connected to the left side 126 of the cage 120. The brackets 160 extend upwardly from the sides 125,126 of the cage 120 with the short legs 160*b* of the brackets 160 facing one another above the cage 120. The center of the yoke 150 is sandwiched between and pivotally connected to the short legs 160*b* of the brackets 160 by means of a center pin 161.

The front 153 and rear 154 legs of the yoke 150 extend into the longitudinal raceway 130 through a longitudinal slit 129 in the top 121 of the cage 120. The legs 153,154 extend a sufficient distance into the longitudinal raceway 130 to insure that the sphere 190 remains between the legs 153,154 at all times.

Figure 9A:
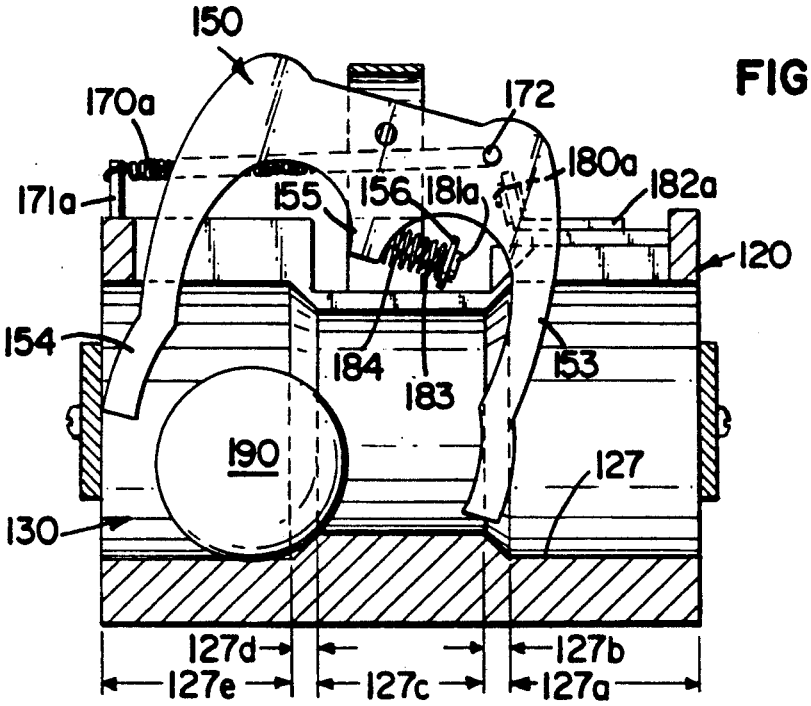
FIG. 9*a* is a cross-sectional view of the switch depicted in FIG. 8 taken along line 9—9 depicting the switch in an electrically open position.
Figure 9B:
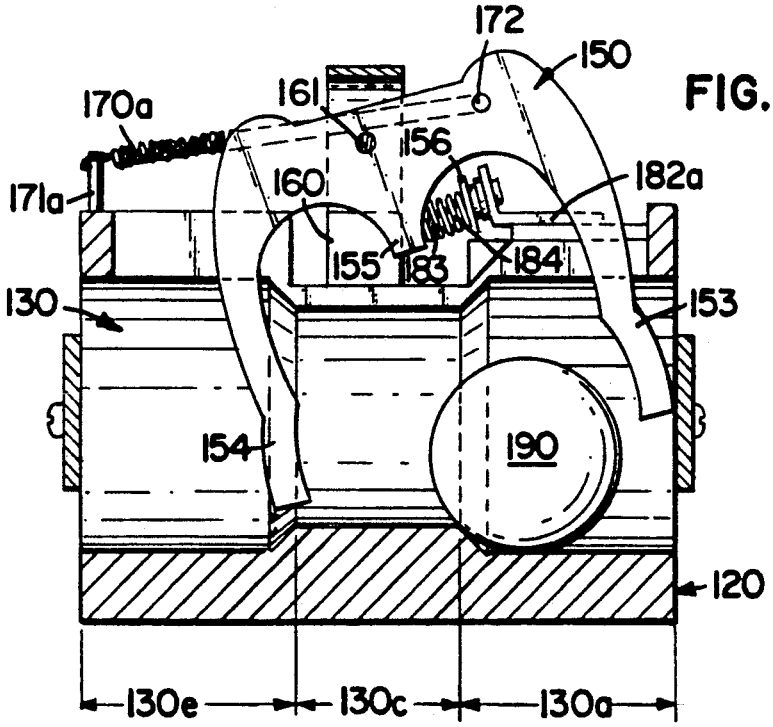
FIG. 9*b* depicts the switch of FIG. 9*a* in an electrically closed position.

Longitudinal movement of the sphere 190 within the raceway 130 between the front 130*a* and rear 130*e* portions of the raceway 130 causes the sphere 190 to strike the legs 153,154 of the yoke 150 and pivot of the yoke 150 between a first pivot position and a second pivot position depicted in FIGS. 9*a* and 9*b*.

A front pair of right and left stationary electrical contacts 180*a*,180*b* are separately mounted upon the top 121 of the cage 120 by a pair of L-shaped mounting brackets 182*a*,182*b*. The front pair of electrical contacts 180*a*,180*b* face the rear 124 of the cage 120 and extend over a lateral channel 128 in the top 121 of the cage 120.

A front pair of right and left positionable electrical contacts 181*a*,181*b* are mounted upon opposite ends of a lateral extension bar 156 which is connected to a central projection 155 on the yoke 150. The central projection 155 extends between the legs 153,154 of the yoke 150 into the lateral channel 128 in the top 121 of the cage 120. The front pair of positionable electrical contacts 181*a*,181*b* are configured in conjunction with the front pair of stationary electrical contacts 180*a*,180*b* so as to provide an electrical connection of the corresponding right 180*a*,181*a* and left 180*b*,181*b* electrical contacts when the yoke is in one pivoted position and prevent electrical connection of the corresponding right 180*a*,181*a* and left 180*b*,181*b* electrical contacts when the yoke is in the other pivoted position.

The laterally extending channel 128 on the top 121 of the cage 120 is provided with sloped front and rear walls (unnumbered) to permit arcuate movement of the front positionable electrical contacts 181*a*,181*b* between the electrically open and electrically closed positions.

The lateral extension bar 156 is reciprocally mounted onto the center projection 155 of the yoke 150 by means of an extension shaft 183. A spring 184 is provided around the extension shaft 183 and retained between the lateral extension bar 156 and the center projection 155 for biasing the front positionable electrical contacts 181*a*,181*b* towards the front stationary electrical contacts 180*a*,180*b*. Biasing of the front positionable electrical contacts 181*a*,181*b* towards the front stationary electrical contacts 180*a*,180*b*, assists in assuring effective contact between the positionable 181*a*,181*b* and stationary 180*a*,180*b* contacts when the yoke 150 is in the first pivotable position.

The first electrical cord 220 connected to the float switch 100 includes a live wire (unnumbered) and a return wire (unnumbered) with the live wires coupled to the front right stationary electrical contact 180*a* and the return wire connected to the front left stationary electrical contact 180*a*. Flow of electricity is provided from the live wire to the return wire so as to complete the electrical circuit by simultaneously coupling the front right stationary electrical contact 180*a* to the right positionable electrical contact 181*a* and the front left stationary electrical contact 180*b* to the left positionable electrical contact 181*b*. Such coupling of the front electrical contacts 180*a*,180*b*,181*a*,181*b* permits electricity to sequentially flow from the live wire to the return wire through (i) the front right stationary electrical contact 180*a*, (ii) the front right positionable electrical contact 181*a*, (iii) the lateral extension bar 156, (iv) the front left positionable electrical contact 181*b*, and (v) the front left stationary electrical contact 180*b*.

Biasing of the yoke 150 towards the appropriate first or second pivotable positions is provided by a pair of longitudinal springs 170*a*,170*b* which are coupled at a first end (unnumbered) to the cage 120 proximate the back 124 of the cage 120 and at a second end (unnumbered) to the yoke 150 between the pivot point 161 and the front 123 of the cage 120. The springs 170*a*,170*b* are connected to the cage 120 by means of a pair of vertical posts 171*a*,171*b* and connected to the yoke 150 by means of a laterally extending connector pin 172. The springs 170*a*,170*b* are vertically positioned with respect to the pivot point 161 so as to provide biasing of the yoke 150 to remain in the first pivotable position when the yoke 150 is in the first pivotable position and biasing of the yoke 150 to remain in the second pivotable position when the yoke 150 is in the second pivotable position. Such a dual biasing effect is obtained by vertically positioning the springs 170*a*,170*b* so that the springs 170*a*,170*b* pass through the axis of the pivot point 161 as the yoke 150 moves between the first and second pivotable positions. Referring to FIGS. 9*a* and 9*b*, the springs 170*a*,170*b* bias the yoke 150 towards the front 123 of the cage 120 when the yoke 150 is in a first pivoted position (springs 170*a*,170*b* above pivot point 161) and bias the yoke 150 towards the back 124 of the cage 120 when the yoke 150 is in a second pivoted position (springs 170*a*,170*b* below pivot point 161).

The cage 120, cover plates 143,144, yoke 150, and brackets 160 may be constructed from substantially any structural material possessing sufficient structural integrity regardless of electrical conductivity including specifically, but not exclusively, plastics such as polyester and polyvinylchloride and metals such as aluminum and steel.

Proper functioning of the switch 100 requires that the force exerted upon the yoke 150 by the sphere 190 in the longitudinal direction when the sphere 190 strikes one of the legs 153,154 will always be sufficient to overcome a combination of the longitudinal biasing force applied to the yoke 150 by the springs 170*a*,170*b* and the frictional forces acting upon the yoke 150.

The longitudinal force applied to the yoke 150 by the sphere 190 is attributable to a combination of the longitudinal momentum of the sphere 190 when the sphere 190 strikes the yoke 150 and the linear distance between the point at which the sphere 190 contacts the yoke 150 and the pivot point 161 of the yoke 150. The momentum of the sphere 190 when the sphere 190 strikes the yoke 150 is dictated by the mass of the sphere 190 and the velocity of the sphere 190 when the sphere 190 strikes the yoke 150. Because movement of the sphere is based upon gravity, the velocity of the sphere 190 when the sphere 190 strikes the yoke 150 is dictated by the vertical distance traveled by the sphere 190 prior to striking the yoke 150. The vertical distance traveled by the sphere 190 prior to striking the yoke 150 is the vertical distance between the restraining inclined surface 127*b* or 127*d* and the point at which the sphere 190 contacts the yoke 150. The vertical distance between the restraining inclined surface 127*b*,127*d* and the point at which the sphere 190 contacts the yoke 150 is a function of the linear distance between these two points and the vertical angle achieved by the raceway 130 prior to release of the sphere 190. The vertical angle achieved by the raceway 130 prior to release of the sphere 190 is dictated by the angle of the restraining inclined surface 127*b* or 127*d*.

Accordingly, in the final analysis, the longitudinal force applied to the yoke 150 by the sphere 190 depends upon a combination of (i) the linear distance between the point at which the sphere 190 contacts the yoke 150 and the pivot point 161 of the yoke 150, (ii) the linear distance between the restraining inclined surface 127*b*,127*d* and the point at which the sphere 190 contacts the yoke 150, (iii) the angle of the restraining inclined surface 127*b*,127*d*, and (iv) the mass [size and density] of the sphere 190,.

The yoke 150 should be constructed with a linear distance of at least about 2 cm and most preferably about 3 to about 6 cm between the point at which the sphere 190 contacts the yoke 150 and the pivot point 161 of the yoke 150 in order to provide effective repositioning force to the yoke 150 without constructing an unwieldy switch.

Likewise, the raceway 130 should be constructed to retain the sphere 190 and the yoke 150 at a linear distance of at least about 1 cm and most preferably about 2 to about 5 cm until the sphere 190 is released in order to provide effective repositioning force to the yoke 150 without constructing an unwieldy switch.

The inclined surfaces 127*b*,127*d* are preferably angled such that the raceway 130 must achieve a vertical angle of at least about 10° most preferably about 30° to about 65°, before releasing the sphere 190. Angles of less than about 10° are difficult to consistently obtain under normal operation conditions and can result in failure of the switch 100.

The sphere 190 should be constructed from a fairly dense material in order to maximize the momentum available to reposition the yoke 150 against the bias of the springs 170*a*,170*b*. Accordingly, the sphere 190 is preferentially constructed from such materials as steel or iron.

Figure 10:
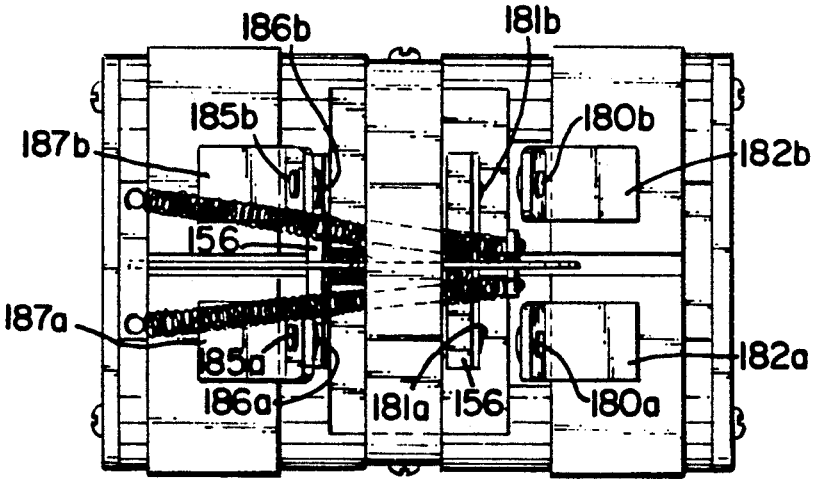
FIG. 10 is a top view of a second embodiment of the invention.
Figure 11A:
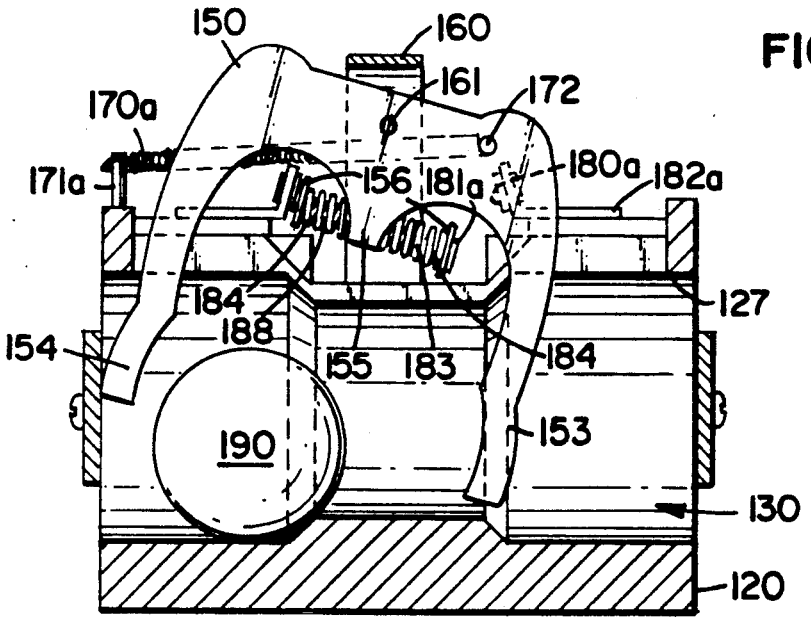
FIG. 11*a* is a cross-sectional view of the switch depicted in FIG. 10 taken along line 11—11 with the switch in a first position.
Figure 11B:
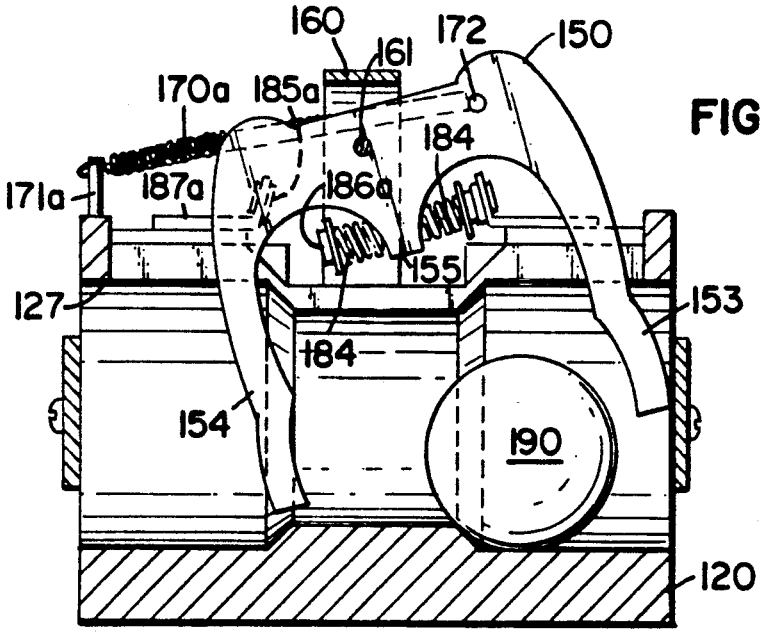
FIG. 11*b* depicts the switch of FIG. 11*a* in a second electrical position.

Referring to FIGS. 10, 11*a* and 11*b*, an alternative embodiment of the float switch 100 further includes a rear pair 185*a*,185*b* of stationary electrical contacts and a corresponding rear pair of positionable electrical contacts 186*a*,186*b* which are simply mirror images of the front set 180*a*,180*b*,181*a*,181*b*. The rear set of electrical contacts 185*a*,185*b*,186*a*,186*b* are electrically opened and closed in direct opposition to the front set 180*a*,180*b*,181*a*,181*b* such that when one set is electrically closed the other set will be electrically open.

The pumping range 300 is dictated by a combination of the angle of the inclined surface portions 127*b*,127*d* and the length of cord 220 provided between the stand pipe 240 and the float switch 100.

Referring to FIGS. 5*a* and 5*b*, the switch 100 is sealed within a chamber 114 defined by a substantially cylindrical housing 110. The switch 100 is configured within the housing 110 so that the raceway 130 longitudinally extends from the top 111 to the bottom 112 of the housing 110 and the sphere 190 will roll between the front portion 130*a* and the rear portion 130*e* of the raceway 130 based upon the relative heights of the top 111 and bottom 112 of the housing 110. A dual wire electrical cord 220 extends into the housing 110 and into contact with the front stationary electrical contacts 180*a*,180*b* through an orifice 115 in the base 112 of the housing 110.

The switch 100 may be employed to control various electrical equipment based upon the level of a liquid within a reservoir. FIG. 4 depicts use of the switch 100 to control a submersible pump 250. The switch 100 is connected to a source of electricity 210 by a first electrical cord 220 with a piggy back plug 221. The pump 250 is connected to the source of electricity 210 by a second electrical cord 230 which is plugged into the piggy back plug 221. Flow through the piggy back plug 221 to the second cord 230 is controlled by the float switch 100 which is electrically open to prevent the flow of electricity to the pump 250 after the float switch 100 reaches the lowest point 302 of the pumping range 300 and is electrically closed to permit the flow of electricity to the pump 250 after the float switch 100 reaches the highest point 301 of the pumping range 300.

Operation

A liquid level within the reservoir which is at or below the bottom 302 of the pumping range 300 causes switch 100 to occupy a downward position such as depicted in FIG. 5*b*. In the downward position, (i) the switch 100 is electrically open, (ii) the sphere 190 is retained within the rear retention portion 130*e* of the raceway 130, (iii) the yoke 150 is in the second pivotable position towards the rear 124 of the cage 120, and (iv) the springs 170*a*,170*b* bias the yoke towards the rear 124 of the cage 120. As the liquid level increases, the raceway 130 angles upward past horizontal until the sphere 190 rolls toward the front 121 of the cage and into contact with the rear inclined surface 127*d*. Further increases in the liquid level causes the switch 100 to reach the top 301 of the pumping range 300 at which time the sphere 190 rolls over the rear inclined surface 127*d*, through the central transitory portion 130*c* of the raceway 130, into contact with the front leg 153 of the yoke 150 so as to pivot the yoke 150 past a transitional pivot position, and into the front retention portion 130*a* of the raceway 130. Once the yoke has been pivoted past the transitional pivot position, the springs 170*a*,170*b* complete repositioning of the yoke 150 into the first pivotable position as they are then positioned to bias the yoke towards the front 121 of the cage 120 and into the first pivotable position. In the first pivotable position the switch 100 is electrically closed with the front positionable electrical contacts 181*a*,181*b* coupled to the front stationary electrical contacts 180*a*,180*b* and retained in the closed position by the springs 170*a*,170*b*.

Movement of the switch 100 from electrically closed to electrically opened is simply a reverse of the described sequence with the sphere 190 moving from the front retention portion 130*a* of the raceway 130 to the rear retention portion 130*e* and the yoke pivoting from the first pivotable position proximate the front 123 of the cage 120 to the second pivotable position proximate the rear 124 of the cage 120.

The specification is intended to aid in a complete non-limiting understanding of the invention. Since many variations and embodiments of the invention may be created without departing from the spirit and scope of the invention, the scope of the invention resides in the claims hereinafter appended.

I claim:

1. A switch used in a float switch system, the switch comprising:

a cage defining a longitudinal raceway:

a yoke pivotally mounted to an exterior of the cage and having first and second legs which extend into the raceway;

biasing means capable of biasing the yoke in a first direction when the yoke is in a first position and biasing the yoke in a second direction, which is substantially diametrically opposed to the first direction, when the yoke is in a second position;

electrical switching means which is electrically open when the yoke is in the first position and electrically closed when the yoke is in the second position, wherein the electrical switching means includes first and second electrical contacts, the first electrical contact mounted to the cage, the second electrical contact mounted to the yoke, the second electrical contact movable with the yoke as the yoke is pivoted between the first position and the second position, the second electrical contact being in electrical contact with the first electrical contact when the yoke is in the second position, and the second electrical contact being spaced apart from the first electrical contact when the yoke is in the first position; and means for urging the yoke between the first and second positions against the bias of the biasing means based upon the longitudinal angle of the raceway.

2. The switch of claim 1, further comprising third and fourth electrical contacts, and an electrical connector member, the third electrical contact mounted to the cage, the fourth electrical contact mounted to the yoke, the second and fourth electrical contacts connected by the electrical connector member, the first and third electrical contacts connectable to an external electrical power supply.

3. The switch of claim 1, wherein the yoke is pivotally mounted about a pivot axis and the biasing means is a spring which passes through the pivot axis as the yoke pivots between the first and second positions.

4. The switch of claim 1, further comprising contact biasing means for biasing at least one of the electrical contacts towards the other.

5. The switch of claim 1, further comprising second electrical switching means which is electrically closed when the yoke is in the first position and electrically open when the yoke is in the second position, wherein the second electrical switching means includes first and second electrical contacts, the first electrical contact mounted to the cage, the second electrical contact mounted to the yoke.

6. The switch of claim 1, wherein the means for urging the yoke between the first and second positions is a sphere and the raceway has a substantially circular longitudinal cross-section and defines a longitudinal axis.

7. The switch of claim 6, wherein one of the first and second legs of the yoke at least partially supports the sphere when the yoke is in the second position in all orientations of the raceway about the longitudinal axis.

8. The switch of claim 6, wherein the sphere contacts one of the first and second legs of the yoke to apply a closing force to the yoke during movement of the yoke from the first position to the second position, the closing force acting to rotate the yoke about a pivot axis of the yoke against the biasing means, the closing force transmitted through the yoke to apply a contact force to the first and second electrical contacts as the yoke moves to electrically close the contacts, the contact force influenced by the weight of the sphere.

9. The switch of claim 6, wherein the sphere contacts one of the first and second legs of the yoke to apply an opening force to the yoke during movement of the yoke from the second position to the first position, the opening force acting to rotate the yoke about the pivot axis of the yoke against the biasing means, the opening force transmitted through the yoke to apply a separating force to separate the contacts as the yoke moves to electrically open the contacts, the separating force influenced by the weight of the sphere.

10. The switch of claim 1, wherein the first and second yoke legs project continuously into the raceway.

11. A switch used in a float switch system, the switch comprising:

a cage defining a longitudinal raceway having a longitudinal axis;

a yoke pivotally mounted to an exterior of the cage about a pivot axis, the yoke having first and second legs which project continuously into the raceway the legs of the yoke each extending into the raceway in a non-parallel direction to the longitudinal axis of the raceway at all times during operation of the switch;

biasing means capable of biasing the yoke in a first direction when the yoke is in a first position and biasing the yoke in a second direction, which is substantially diametrically opposed to the first direction, when the yoke is in a second position;

electrical switching means which is electrically open when the yoke is in the first position and electrically closed when the yoke is in the second position; and a sphere positioned within the raceway between the first and second legs of the yoke at all times during operation of the switch, the sphere urging the yoke between the first and second positions against the biasing of the biasing means based upon the longitudinal angle of the raceway.

12. The switch of claim 11, wherein the electrical switching means includes first and second electrical contacts, the first electrical contact mounted to the cage, the second electrical contact mounted to the yoke, the second electrical contact movable with the yoke as the yoke is pivoted between the first position and the second position, the sphere applying a force to the yoke as the yoke is moved by the sphere between the first and second positions, the force applied by the sphere to the yoke being transmitted through the yoke to the first and second electrical contacts to make electrical contact between the electrical contacts or break electrical contact between the electrical contacts during pivoting movement of the yoke between the first and second positions, the force applied to the contacts to make or break electrical contact influenced by the weight of the sphere.

* * * * *

UNITED STATES PATENT AND TRADEMARK OFFICE

CERTIFICATE OF CORRECTION

PATENT NO. : 5,087,801

DATED : February 11, 1992

INVENTOR(S) : Stephen P. Johnston

It is certified that error appears in the above-identified patent and that said Letters Patent is hereby corrected as shown below:

On the title page item [56] add the following Reference Cited:

| | | |
|---|---|---|
| --1,175,062 | 3/1916 | Johnson |
| 1,692,155 | 11/1928 | Brownell |
| 1,854,316 | 4/1932 | Teesdale |
| 2,291,245 | 7/1942 | Lorraine |
| 2,296,053 | 9/1942 | Porter et al. |
| 2,642,507 | 6/1953 | West |
| 2,832,864 | 4/1958 | Rapp |
| 2,833,903 | 5/1958 | Waddell |
| 2,949,783 | 8/1990 | Butler |
| 3,026,387 | 5/1962 | Ashdaugh |
| 3,483,341 | 12/1969 | Reichensperger |
| 3,518,385 | 6/1970 | Boudes et al. |
| 3,650,347 | 3/1972 | Campos |
| 3,746,035 | 7/1973 | Singer |
| 3,753,474 | 8/1973 | Dillmann |
| 3,944,770 | 3/1976 | Pepper |
| 4,021,144 | 5/1977 | Matsusaka |
| 4,084,073 | 4/1978 | Keener |
| 4,104,492 | 8/1978 | Pliml, Jr. |
| 4,215,975 | 8/1980 | Niedermeyer |
| 4,302,641 | 11/1981 | Johnston |
| 4,373,155 | 2/1983 | Dola |
| 4,378,475 | 3/1983 | McNiel |
| 4,629,841 | 12/1986 | Riback et al. |
| 4,644,117 | 2/1987 | Grimes et al.-- |

UNITED STATES PATENT AND TRADEMARK OFFICE

CERTIFICATE OF CORRECTION

PATENT NO. : 5,087,801

DATED : February 11, 1992

INVENTOR(S) : Stephen P. Johnston

It is certified that error appears in the above-identified patent and that said Letters Patent is hereby corrected as shown below:

INSERT the following in the FOREIGN PATENT DOCUMENTS section:

| | | |
|---|---|---|
| --595,900 | 10/1925 | France |
| 316,885 | 4/1934 | Italy |
| 198,280 | 9/1938 | Switzerland |
| 146,584 | 8/1954 | Sweden-- |

INSERT the following in the OTHER DOCUMENTS section:

--Enpo Pump Company catalog pages entitled "Liquid Level Controls for Submersible Non-Clog Pumps", 2 pages, dated 5/1982.

Solo-float catalog pages from Anchor Scientific Inc., 2 pages, dated 1/1987.

Myers catalog page entitled "MFLC SERIES Mercury Free Mechanical Float Switches", 1 page, dated 3/1990.--

UNITED STATES PATENT AND TRADEMARK OFFICE

CERTIFICATE OF CORRECTION

PATENT NO. : 5,087,801

DATED : February 11, 1992

INVENTOR(S) : Stephen P. Johnston

It is certified that error appears in the above-identified patent and that said Letters Patent is hereby corrected as shown below:

On the title page item [73] delete "Detroit, Mich." and insert --Detroit Lakes, Minn.-- .

Column 6, lines 29-30, "1-81a" should read --181a--.

Signed and Sealed this

Seventeenth Day of November, 1992

*Attest:*

DOUGLAS B. COMER

*Attesting Officer*

*Acting Commissioner of Patents and Trademarks*